United States Patent [19]

Reed

[11] Patent Number: 4,834,262

[45] Date of Patent: May 30, 1989

[54] TRASH SEPARATION CONTAINER

[76] Inventor: Mel Reed, 14013 Pawnee La., Lockport, Ill. 60441

[21] Appl. No.: 206,879

[22] Filed: Jun. 13, 1988

[51] Int. Cl.[4] ..... B65D 1/24; B65D 21/02

[52] U.S. Cl. ..... 220/404; 220/1 T; 220/20; 220/23.8; 220/23.6

[58] Field of Search ..... 220/404, 1 T, 23.8; 206/518

[56] References Cited

U.S. PATENT DOCUMENTS

| | | | |
|---|---|---|---|
| 3,397,804 | 8/1968 | Davis | 220/20 |
| 3,893,615 | 7/1975 | Johnson | 232/43.2 |
| 4,428,493 | 1/1984 | McDonough | 220/20 |
| 4,715,572 | 12/1987 | Robbins | 248/101 |
| 4,729,489 | 3/1988 | Papaianni | 220/23.8 |
| 4,753,367 | 6/1988 | Miller | 220/404 |

FOREIGN PATENT DOCUMENTS

| | | | |
|---|---|---|---|
| 2407870 | 11/1977 | France | 138/92 |

*Primary Examiner*—Stephen Marcus
*Assistant Examiner*—Gilbert W. Reece
*Attorney, Agent, or Firm*—Douglas B. White

[57] ABSTRACT

There is provided an apparatus for a compartmentalized trash separation container which is compatible with plastic bags and used to separate garbage for recycling purposes, and further having a compartment specially designed for receipt of newspapers or the like. There is provided a retaining apparatus in which the plastic bags installed within the compartments of the container would drape over protruding lips around the compartments. A retainer member with a protruding edge arranged to substantially circumscribe the protruding lips of each compartment is aligned, pressed over the bag and locked in place. The locking mechanism, in one embodiment, is a frictional block arranged to press against the protruding edge of the retainer, and alternatively the lock comprises a ribbed protrusion arranged to lock within a ribbed receptacle.

5 Claims, 2 Drawing Sheets

FIG. 2
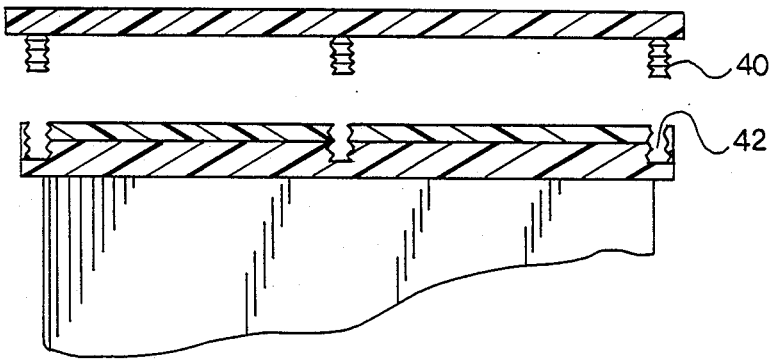
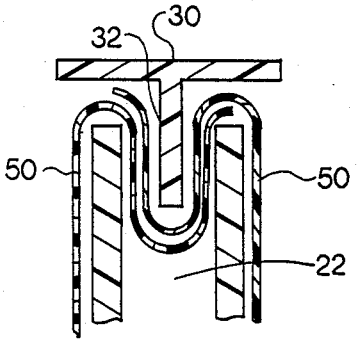
FIG. 3
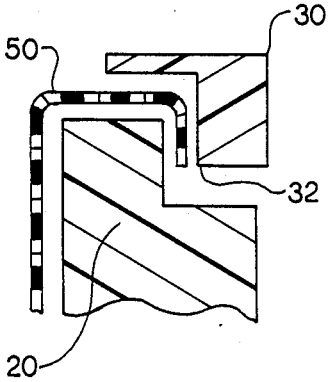
FIG. 4

TRASH SEPARATION CONTAINER

BACKGROUND OF THE INVENTION

1. Field of the Invention

This invention relates primarily to waste containers normally found and used in a home, and more particularly relates to containers useful for the separation of the various types of garbage within a single container.

2. Description of the Prior Art

Garbage and waste containers typically found in the home have been adapted in recent years to the use of plastic garbage bags. These bags are generally draped over a lip or edge formed on the upper periphery of the container. Installation of the bag is a routine and simple procedure of pushing the bag into the container and turning the upper portion of the bag out and over the container edge.

Recently, the need to separate waste has become desirable and even mandatory under some local ordinances. Unfortunately the use of the garbage bag is complicated if one were to attempt to apply the bag to a multiple compartment container. While multiple compartment containers have been described in the art, a feasible design which is compatible with the bags and proposes an effective and easy installation is needed.

In a very recent patent, U.S. Pat. No. 4,729,489, there is described a container having multiple compartments and a protruding lip around each compartment to accept the plastic bag. However, due to the closeness of the compartments and the position of the lips between the compartments, it is difficult to install the bag, and when the bag is in place it is not held securely.

SUMMARY OF THE INVENTION

Accordingly, it is a principal object of the present invention to provide a compartmentalized trash separation container which is compatible with plastic bags in order to separate garbage for recycling purposes.

It is a further object to provide a compartmentalized trash separation container which securely locks the bags in place.

In yet a further embodiment of the invention it is an object to provide a device which is both time saving and compact.

It is finally an object of the present invention to provide a compartmentalized trash separation container having a specially designed space for receipt of newspapers or the like.

Generally there is provided a compartmentalized trash separation container which is both a space saving way to store many different types of garbage and a time saving way to separate garbage for recycling purposes. There is further provided a bag securing mechanism in which the plastic bag within a compartment of the container would drape an upper protruding lip of the compartment and be secured thereto. When all bags are in place, a retainer member with a protruding edge arranged to substantially circumscribe each compartment lip is aligned and pressed onto the container over the bag, whereby the bag is locked in place. In a further aspect the retainer member is secured by a frictional fit against blocks affixed to the upper periphery of the container. And in yet a further aspect, there is provided a locking mechanism in the form of a ribbed protrusion affixed to the retainer member and a ribbed receptacle affixed to the container, whereby insertion provides an additional lock.

BRIEF DESCRIPTION OF THE DRAWINGS

FIG. 2 is a front elevational view of the top edge of the container and the bag retainer member arranged to engage with the top edge of the container.

FIG. 3 is a cross sectional view of a portion of the internal divider edge of the container and retainer member showing the bag held in place by the retainer.

FIG. 4 is a cross sectional view of a portion of the peripheral edge of the container and retainer.

Figure 1:
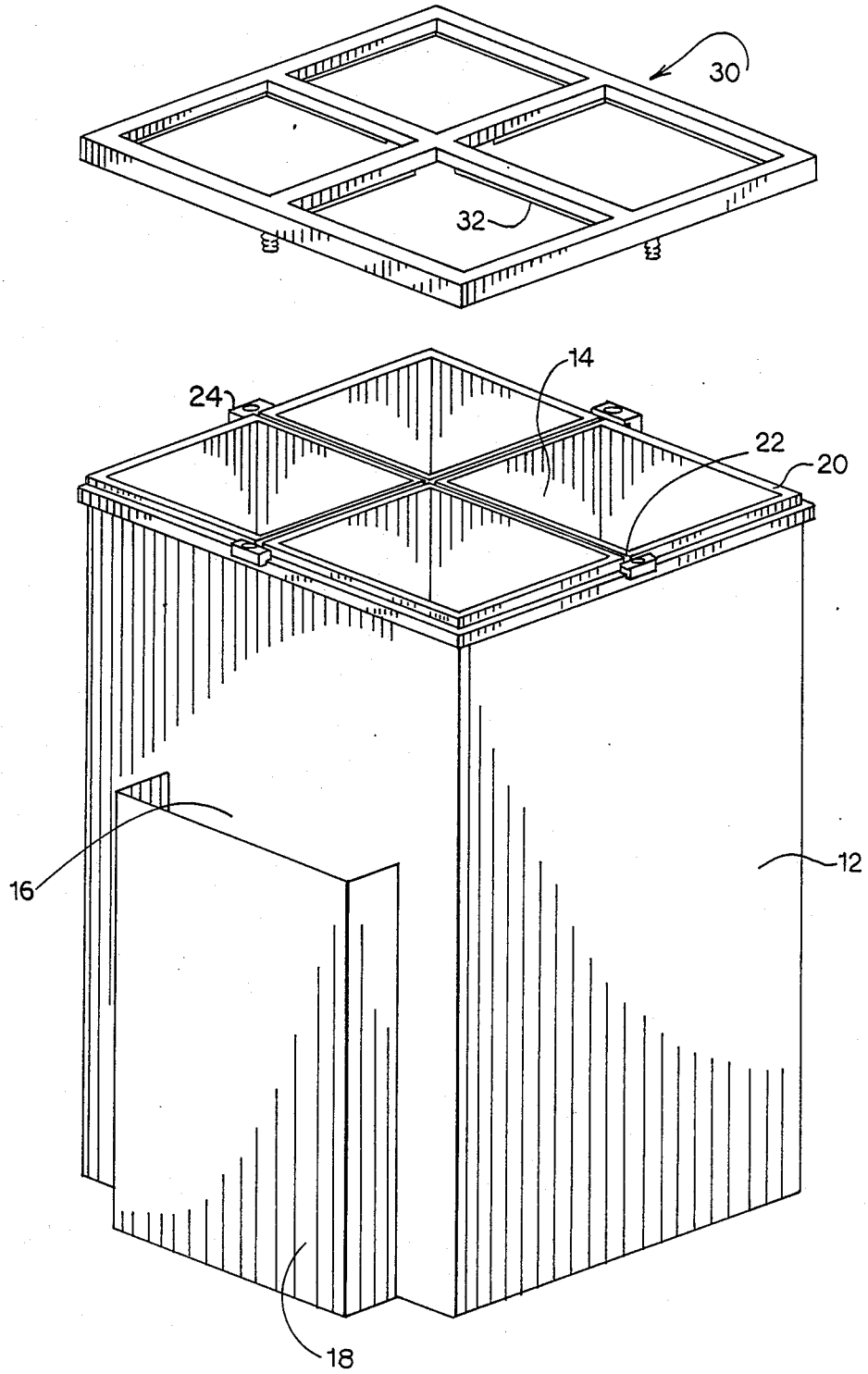
FIG. 1 is a perspective view of the compartmentalized trash container of the present invention showing the container separated into quadrants and having an additional specialized compartment positioned along one side for receipt of newspapers.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Turning first to FIG. 1 there is shown the compartmentalized trash container of the present invention comprising side members 12 fixed together to form a container of substantially rectangular cross section. This container is divided into sections or compartments by partitions 14. An additional section or compartment 16 for the receipt of newspapers is formed onto one of the sides by the addition of an external enclosing wall 18.

Surrounding the upper periphery of each compartment, there is provided a protruding vertical lip 20. When these protruding lips are paired next to each other at adjoining compartments there is formed slots 22 therebetween. At the peripheral edge of the slots 22 there is positioned blocks 24 for frictionally securing thereto the retainer member 30.

The retainer member is comprised of peripheral and cross members arranged to fit around each compartment opening. More particularly, there is provided a protruding edge 32 arranged to fit within the slot defined between the compartments and to fit outside the compartment periphery and thereby substantially circumscribe each compartment lip. At the center of the container where all bags will overlap, this protruding edge is preferably omitted and the cross members will rest directly on the bags.

To further enhance the locking of the retainer to the container there is provided in a further embodiment a locking mechanism comprising a ribbed protrusion 40 arranged to extend from spaced peripheral points on the retainer member. Receptacle holes 42 are defined at the container edge to mate with the ribbed protrusion. In the preferred embodiment the protrusions would be arranged to mate with receptacles defined within the blocks 24 on the edge of the container.

During use one would place a bag 50 within a compartment of the container and drape the upper edge thereof over the protruding lips of the compartment. The bag placement at the internal sections and at the periphery would appear as shown in FIG. 3 and FIG. 4 respectively. When all bags are in place, the retainer member is aligned and pressed onto the container over the bag where it is locked in place by use of the blocks 24 and the protrusion/receptacle lock.

From the foregoing description, it will be apparent that modifications can be made to the apparatus without departing from the teaching of the present invention. Accordingly the scope of the invention is only to be limited as necessitated by the accompanying claims.

I claim:

1. A compartmentalized trash separation container for use with trash bags installed within the compartments comprising:

outer side walls and inner sectional walls arranged to define compartments within a container, said inner sectional walls intersecting at a common point to define multiple compartments distributed thereabout;

an upward protruding lip arranged around the upper periphery of each compartment to support a turned-over edge of a trash bag;

a retainer member arranged to mate against said lips and to secure a bag installed within the compartment and having an edge turned over said lips, wherein said retainer member further comprises an edge protruding therefrom and arranged to substantially circumscribe said upward protruding lips of each compartment but leaving a gap proximate said point of intersection of said inner sectional walls; and means for securing said retainer member to said container.

2. The compartmentalized trash separation container of claim 1 further comprising an additional separate enclosure positioned on and partially covering one side of the container.

3. The compartmentalized trash separation container of claim 1 wherein said means for securing said retainer comprises a plurality of block members affixed to said container at its upper periphery proximate said upward protruding lip and arranged to provide a frictional contact against the protruding edge of said retainer member.

4. The compartmentalized trash separation container of claim 1 wherein said means for securing said retainer comprises a plurality of frictional locks having mating members arranged to be positioned one inside the other.

5. The compartmentalized trash separation container of claim 4 wherein said frictional locks comprise a ribbed protrusion arranged to be inserted within a ribbed receptacle.

* * * * *